US008978560B1

(12) United States Patent
Stepanov et al.

(10) Patent No.: US 8,978,560 B1
(45) Date of Patent: Mar. 17, 2015

(54) SHOCK MITIGATION BARRIER FOR WARHEADS

(75) Inventors: Victor Stepanov, Highland Park, NJ (US); Ernest L. Baker, Wantage, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 1208 days.

(21) Appl. No.: 12/879,230

(22) Filed: Sep. 10, 2010

(51) Int. Cl.
*F42B 12/20* (2006.01)
*F42B 39/14* (2006.01)
*F42B 3/22* (2006.01)

(52) U.S. Cl.
CPC ..... *F42B 3/22* (2013.01); *F42B 12/208* (2013.01)
USPC ..... 102/481; 102/479

(58) Field of Classification Search
CPC ..... F42B 12/76; F42B 12/80; F42B 12/207; C06B 45/12; C06B 45/00–45/36
USPC ..... 102/473, 478, 479, 481, 491
See application file for complete search history.

(56) References Cited

U.S. PATENT DOCUMENTS 5,054,399 A * 10/1991 Bilek et al. ..... 102/481
5,243,916 A * 9/1993 Freche et al. ..... 102/481

* cited by examiner

*Primary Examiner* — James S Bergin
(74) *Attorney, Agent, or Firm* — Henry S. Goldfine

(57) ABSTRACT

A nanocomposite explosive liner for a main fill charge in a warhead may include a secondary high explosive having a mean crystal size less than about one micron, and a binder. The porosity of the liner may be in a range of about 1% to about 20%. A weight percentage of the binder in the liner may be in a range of about 1% to about 20%.

20 Claims, 1 Drawing Sheet

SHOCK MITIGATION BARRIER FOR WARHEADS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to explosive warheads and in particular to the mitigation of inadvertent detonation or deflagration of warheads.

Munitions may be susceptible to inadvertent detonation from stimuli such as, for example, shock waves. Shock waves may originate from a nearby detonation or upon impact of a munition with a target. The susceptibility of a given munition to shock may depend on the explosive charge composition in the munition. The sensitivity of explosives may increase with power. Increasingly stringent safety requirements may require more complicated munition designs.

To address shock mitigation of warheads, inert liner materials that are metal or plastic-based have been considered (see, for example, U.S. Pat. No. 5,054,399 issued to Bilek on Oct. 8, 1991). Such approaches may be effective for incident shock wave attenuation. A drawback of such approaches may be loss of warhead performance due to displacing the main fill explosive with an inert material.

A need exists for an apparatus and method for mitigating inadvertent shock wave detonation of a warhead, while minimizing the loss of performance of the warhead.

SUMMARY OF THE INVENTION

It is an object of the invention to provide an apparatus and method for mitigating inadvertent detonation or deflagration of explosive material, while minimizing the loss of performance of the warhead.

One aspect of the invention is a liner for a warhead. The warhead may contain a main fill explosive. The liner may include a secondary high explosive having a mean crystal size less than about one micron, and a binder. The porosity of the liner may be in a range of about 1% to about 20%. The weight percentage of the binder in the liner may be in a range of about 1% to about 20%.

The secondary high explosive may be, for example, RDX. The mean crystal size may be less than about 750 nanometers. The porosity of the liner may be in a range of about 5% to about 15%. The weight percentage of the binder in the liner may be in a range of about 8% to about 18%.

Another aspect of the invention is a warhead. The warhead may include a casing, a main fill explosive charge, and a liner disposed between the casing and the main fill explosive charge.

The liner may completely surround the main fill explosive charge. Or, the liner may be disposed between the casing and only a portion of the main fill charge. In one embodiment, the liner may be disposed only at the front of the main fill charge.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
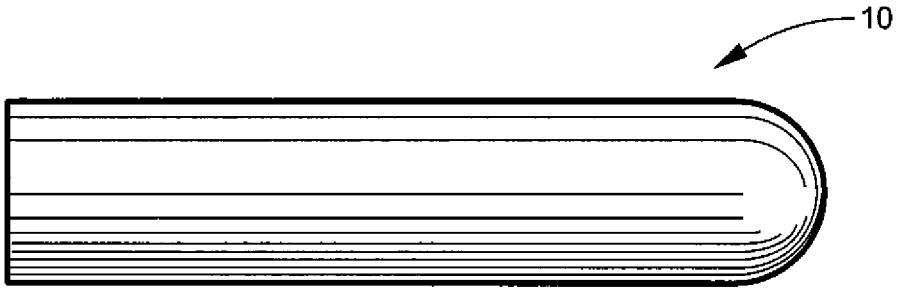
FIG. 1 is a side view of an embodiment of a warhead.

Warhead liners or bathers made of an insensitive explosive may be effective at protecting the more sensitive main fill explosive, because the relatively low acoustic impedance of the warhead liner may modify the stress transmitted from a shock wave. Constructing a warhead liner from an explosive material may boost the performance of the warhead, compared to a warhead with an inert liner.

The choice of an explosive liner material or barrier material may require balancing the shock sensitivity of the material with the explosive power of the material. Relatively low explosive performance may be expected with the most insensitive explosive compositions. An explosive compound with low sensitivity and relatively high explosive performance may be preferred.

Porous materials may be effective at shock attenuation (V. Nesterenko, Dynamics of Heterogeneous Materials, Springer, 2001). The compaction of porous materials may involve plastic flow and void compression. Plastic flow and void compression may result in heating of the material and weakening of the shock wave.

Nanocomposite explosive materials may exhibit a combination of low sensitivity and high performance. Nanocomposite explosive materials may be made of nanocrystalline high explosive material and a binder. The binder may be, for example, a polymeric or wax binder. An example of a wax binder is Chlorowax. An example of a short polymeric binder is VMCC. An example of a long polymeric binder is PVAc.

Several nanocomposite explosives and their respective shock sensitivities are shown in Table 1. The shock sensitivities in Table 1. were determined by the small-scale gap test (MIL STD 1751 A). The porosity in Table 1. is represented as the volume fraction of empty space within the explosive. The compositions of the nanocomposite explosive materials are shown in Table 1. as the relative weight percentage of high explosive and binder, for example, 88/12 is 88% by weight of high explosive and 12% binder.

TABLE 1

Shock sensitivity of nanocomposite explosives.

| Sample | Shock Pressure (kbar) | Porosity |
|---|---|---|
| RDX/Chlorowax (88/12) | 32 | 0.11 |
| RDX/VMCC (83/17) | 33 | 0.07 |
| RDX/PVAc (83/17) | 40 | 0.08 |
| Reference, 4 μm RDX/VMCC(83/17), Slurry coated | 25 | 0.06 |

A protective liner for a warhead may shield the main fill explosive from an incident shock wave. The liner may be made of an insensitive high explosive compound. The insensitive high explosive compound may provide shock protection at a low performance loss, compared to traditional inert liners.

The liner material may be a nanocomposite explosive formulation that includes a powerful secondary explosive in a binder. The secondary explosive may be, for example, RDX, CL-20, or HMX. The low shock sensitivity of a nanocomposite explosive formulation may be due to the very small crystal size of the secondary high explosive. Another favorable property of a nanocomposite explosive formulation may be its low sensitivity to shock, even at substantial levels of porosity. Porosity may aid shock absorbance and may, therefore, further improve the shock attenuation properties in a warhead.

A liner made of a nanocomposite explosive formulation may aid the design of a warhead by combining low sensitivity and high explosive performance, while using traditional, sensitive explosives as the main warhead fills. The majority of known insensitive explosive compositions may be significantly less powerful than a nanocomposite explosive formulation.

A nanocomposite explosive liner may be used with, for example, blast warheads, fragmentation warheads, explosively formed projectiles, and shaped charge warheads. A nanocomposite explosive liner may be beneficial for warheads filled with powerful, sensitive main fills. Powerful, sensitive main fills may include, for example, compositions LX-14, PBXN-9, and A-5.

With respect to shock attenuation, a nanocomposite explosive liner may offer advantages over traditional insensitive explosive liners. With a nanocomposite explosive liner, shock attenuation may be expected due to the low shock impedance of the nanocomposite explosive material. Other low shock impedance materials, such as LUCITE, for example, have been shown to be effective shock shielders.

With a nanocomposite explosive liner, high thermal dissipation may be expected due to the compaction of the porous material. Thermal dissipation may be further enhanced due to the high surface area of the nano-scale high explosive crystals within the nanocomposite explosive liner. The small crystal size of the high explosive crystals may also increase the elastic stress limit, which may be related to improved shock mitigation.

With a nanocomposite explosive liner, the net effect on the incident shock wave may be to lower the peak shock pressure and to increase the shock rise time within the main explosive charge. This effect may result in a lower probability of inadvertent initiation of the warhead. Moreover, the nanocomposite explosive liner may significantly contribute to the explosive performance of the warhead, because the liner may contain powerful explosive material.

A nanocomposite explosive liner may include a nanocomposite explosive formulation, such as the RDX-based compositions in Table 1, or similar compositions. The high explosive component of the nanocomposite explosive formulation may have a mean crystal size less than about one micron, or, in some embodiments, less than about 750 nanometers. The nanocomposite explosive formulation may have a porosity in a range of about 1% to about 20%, or, in some embodiments, in a range of about 5% to about 15%. The explosive compositions may include a weight percentage of binder in a range of about 1% to about 20%, depending on the desired performance and sensitivity.

The choice of binder material may also be used to tailor the protective and performance properties of the liner. For example, higher density binders may be chosen for improved explosive performance. Lower density binders may be chosen for improved shock protection.

The nanocomposite explosive liner may be incorporated into a warhead in several ways. The liner material may envelope the entire main fill explosive within the warhead for blast protection. The liner may be located at the interface of the warhead casing and the main fill explosive.

Figure 2:
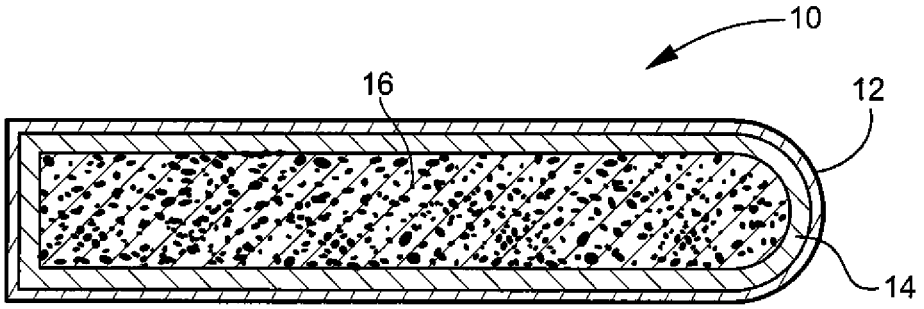
FIG. 2 is a longitudinal section of the warhead of FIG. 1.
Figure 3:
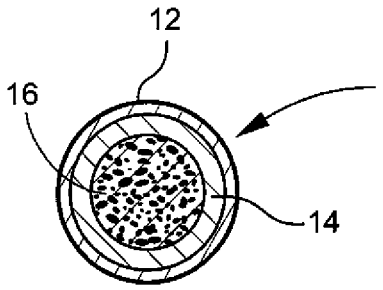
FIG. 3 is a cross-section of the warhead of FIG. 1.

FIG. 1 is a side view of an embodiment of a warhead 10. FIGS. 2 and 3 are longitudinal sections and cross-sections of FIG. 1, respectively. Warhead 10 may include a casing 12, a main fill explosive 16, and a nanocomposite explosive liner 14. Nanocomposite explosive liner 14 may be disposed between the main fill explosive 16 and the casing 12.

A nanocomposite explosive liner may also be applied preferentially to protect from specific shock threats. For example, it may be very desirable to avoid detonation of an anti-armor warhead upon impact with the target. To avoid impact detonation, a nanocomposite explosive liner may be applied only to the front of the main fill charge, where the liner may be most effective at mitigating the strength of the impact shock.

The liner thickness may vary with the amount of protection required. The required thickness of the liner may depend on the shock sensitivity of the main fill charge. The required thickness of the liner may be a function of the liner composition and density, as well as the explosive power of the liner. Selection of these parameters may require optimization based on the design parameters. A warhead with a nanocomposite explosive liner and a main explosive fill may have an explosive power nearly as great as a warhead without the liner. And, the sensitivity of the warhead with a nanocomposite explosive liner and a main explosive fill may be nearly the same as the sensitivity of the liner alone.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A liner for a warhead having a main fill explosive comprising:

a secondary high explosive having a mean crystal size less than about one micron; and a binder;

wherein a porosity of the liner is in a range of about 1% to about 20% and a weight percentage of the binder in the liner is in a range of about 1% to about 20%.

2. The liner of claim 1, wherein the secondary high explosive is RDX.

3. The liner of claim 1, wherein the mean crystal size is less than about 750 nanometers.

4. The liner of claim 1, wherein the porosity of the liner is in a range of about 5% to about 15%.

5. The liner of claim 1, wherein the weight percentage of the binder in the liner is in a range of about 8% to about 18%.

6. A warhead, comprising:

a casing;

a main fill explosive charge; and the liner of claim 1 disposed between the casing and the main fill explosive charge.

7. The warhead of claim 6, wherein the liner completely surrounds the main fill explosive charge.

8. The warhead of claim 6, wherein the liner is disposed between the casing and only a portion of the main fill charge.

9. The warhead of claim 8, wherein the liner is disposed only at a front of the main fill charge.

10. The warhead of claim 6, wherein the mean crystal size is less than about 750 nanometers.

11. The warhead of claim 6, wherein the secondary explosive is RDX.

12. The warhead of claim 6, wherein the secondary explosive is one of CL-20 and HMX.

13. The warhead of claim 6, wherein the porosity of the liner is in the range of about 5% to about 15%.

14. The warhead of claim 6, wherein the weight percentage of the binder in the liner is in the range of about 8% to 18%.

15. A liner for a warhead having a main fill explosive consisting essentially of:

a secondary high explosive having a mean crystal size less than about one micron; and a binder;

wherein a porosity of the liner is in a range of about 1% to about 20% and a weight percentage of the binder in the liner is in a range of about 1% to about 20%.

16. The liner of claim 15, wherein the mean crystal size is less than about 750 nanometers.

17. The liner of claim 15, wherein the weight percentage of the binder in the liner is in a range of about 8% to about 18%.

18. A liner for a warhead having a main fill explosive consisting of:

a secondary high explosive having a mean crystal size less than about one micron; and a binder;

wherein a porosity of the liner is in a range of about 1% to about 20% and a weight percentage of the binder in the liner is in a range of about 1% to about 20%.

19. The liner of claim 18, wherein the mean crystal size is less than about 750 nanometers.

20. The liner of claim 18, wherein the weight percentage of the binder in the liner is in a range of about 8% to about 18%.

* * * * *